US007849811B2

(12) United States Patent
De Baan

(10) Patent No.: US 7,849,811 B2
(45) Date of Patent: Dec. 14, 2010

(54) DISCONNECTABLE MOORING SYSTEM

(75) Inventor: Jacob De Baan, Maassluis (NL)

(73) Assignee: Bluewater Energy Services B.V., Hoofddorp (NL)

( * ) Notice: Subject to any disclaimer, the term of this patent is extended or adjusted under 35 U.S.C. 154(b) by 0 days.

(21) Appl. No.: 12/298,612

(22) PCT Filed: Apr. 2, 2007

(86) PCT No.: PCT/EP2007/053180

§ 371 (c)(1),
(2), (4) Date: Dec. 17, 2008

(87) PCT Pub. No.: WO2007/124999

PCT Pub. Date: Nov. 8, 2007

(65) Prior Publication Data

US 2009/0158985 A1 Jun. 25, 2009

(30) Foreign Application Priority Data

Apr. 27, 2006 (EP) ..... 06113194

(51) Int. Cl.
*B63B 21/24* (2006.01)

(52) U.S. Cl. ..... 114/293

(58) Field of Classification Search ..... 114/293
See application file for complete search history.

(56) References Cited

U.S. PATENT DOCUMENTS

| | | | | |
|---|---|---|---|---|
| 4,446,807 | A * | 5/1984 | Johnson et al. | 114/230.23 |
| 5,041,038 | A | 8/1991 | Poldervaart | |
| 5,584,607 | A | 12/1996 | De Baan | |
| 2004/0029464 | A1 | 2/2004 | Pollack | |

FOREIGN PATENT DOCUMENTS

| | | |
|---|---|---|
| EP | 0668210 | 8/1995 |
| GB | 2239441 | 7/1991 |
| WO | WO 0234616 | 5/2002 |
| WO | WO 02092423 | 11/2002 |
| WO | WO 2006040197 | 4/2006 |

OTHER PUBLICATIONS

International Search Report of the European Patent Office Patent Office in counterpart foreign application No. PCT/EP2007/053180 filed Apr. 2, 2007.

Submitted herewith is a Written Opinion of the European Patent Office Patent Office in counterpart foreign application No. PCT/EP2007/053180 filed Apr. 2, 2007.

* cited by examiner

*Primary Examiner*—Stephen Avila
(74) *Attorney, Agent, or Firm*—Steven M. Koehler; Westman, Champlin & Kelly, P.A.

(57) ABSTRACT

A disconnetable mooring system is provided, comprising a vessel with an outrigger supporting a riser assembly in a disconnectable manner, which riser assembly is provided with a riser top body which by means of disconnectable latching means is attached to the outrigger. The riser top body additionally is connected to the outrigger by means of a braking device for temporarily controlling the downward speed of the riser top body after disconnecting a mechanism. The braking device comprises a first end permanently connected to one of the riser top body and outrigger, and a second end releasably connected to the other of the riser top body and outrigger.

26 Claims, 3 Drawing Sheets

DISCONNECTABLE MOORING SYSTEM

CROSS-REFERENCE TO RELATED APPLICATION

This application is a National Stage Filing of Internation Application PCT/EP2007/053180, filed Apr. 2, 2007 and published as WO 2007/124999 in English.

BACKGROUND

The discussion below is merely provided for general background information and is not intended to be used as an aid in determining the scope of the claimed subject matter.

Aspects of the invention relate to a disconnectable mooring system comprising a vessel with an outrigger supporting a riser assembly in a disconnectable manner, which riser assembly is provided with a riser top body which by means of disconnectable latch is attached to the outrigger.

In offshore oil production, floating production units such as for example vessels are employed to receive effluents from subsea wells. To achieve this, riser assemblies comprising flexible risers with a riser top body are usually employed to connect such wells with the floating production units. In most cases, such floating production units are permanently anchored in the field until its depletion. In some cases however, weather conditions such as severe storms may make it necessary that the floating production facility vacates the field temporarily until the weather conditions improve again. In such case the floating production unit stops production, closes the valves on the wells, and disconnects the riser assembly from the unit. The riser assembly is left in the field to survive the storm on its own. In such case it is important that a proper riser assembly configuration is established such that the riser assembly does not for example get entangled in itself and suffers any damage.

It is also important that the actual riser assembly disconnect and abandonment system is properly designed to allow a safe release of the riser assembly from the floating production unit. Usually this is done by a winch which lowers the more or less buoyant end termination (riser top body) of the riser assembly into the water. After that, the winch wire is released from the winch.

An example of a disconnectable mooring system of the above type is described in U.S. Pat. No. 5,041,038.

With a shift in oil production towards deeper waters and towards the use of more and heavier flexible risers, as well as an increase in the use of dynamically positioned, weathervaning floating production units, the combined loads exerted by the riser assemblies on the disconnect facility become very large. Weathervaning units generally do not have sufficient space to allow the use of individual release connectors and deep waters and large riser assemblies also imply substantial weight of buoyancy means to be carried by the connector and ultimately to be lowered over board.

All of the above lead to the fact that the winch used to haul in and connect the riser assembly to the floating production unit, is generally not capable of lowering the riser assembly but very slowly, with a line speed similar to the pull-in speed. Since usually during disconnecting the wave heights are more severe than during the pull-in, slow release speeds mean that a significant potential for interference exists between the disconnecting elements due to wave action. This in not desirable as it may lead to damage to both the floating production unit as well as the riser top body.

On the other side, while a pure free-fall would be ideal to achieve a quick separation, this is no longer possible since the larger weights of the riser top body would, if released in a free-fall mode, cause the lower-lying parts of the individual risers to experience compression and even buckling.

This is due to the fact that while the disconnect mechanism, including riser top buoyancy assembly, are preferably located above water, the rest of the riser is largely located in the water and hence cannot, due to drag caused by the surrounding water, move quickly enough ahead on the trajectory to be followed by the riser top body.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

An aspect of the present invention is to provide a simple mechanism of lowering a relatively heavy riser assembly quickly enough to achieve a quick separation between disconnecting parts, but slow enough to avoid compression loads to occur in the risers.

Thus, a disconnactable mooring system includes a riser top body that is connected to the outrigger by means of a braking device for temporarily controlling the downward speed of the riser top body after disconnecting the latch mechanism. The braking device comprises a first end permanently connected to one of the riser top body and outrigger, and a second end releasably connected to the other of the riser top body and outrigger.

When the latch mechanism is disconnected, the riser top body will accelerate downward under influence of gravity. However, the braking device will limit this acceleration, such that a controlled downward speed of the riser top body is obtained. At an appropriate moment (for example when the riser top body is lowered to a position in which it starts to pick up some buoyancy from the surrounding sea) the second end of the braking device is disconnected, such that the riser assembly is completely disconnected from the outrigger.

Another aspect of the present invention is a disconnectable mooring system which provides for an automatic disconnection of the riser assembly from the outrigger, once the riser assembly is more or less self floating in the water.

BRIEF DESCRIPTION OF THE DRAWINGS

Hereinafter the invention will be illustrated while referring to the drawings, in which.

DETAILED DESCRIPTION OF THE ILLUSTRATIVE EMBODIMENT

Figure 1:
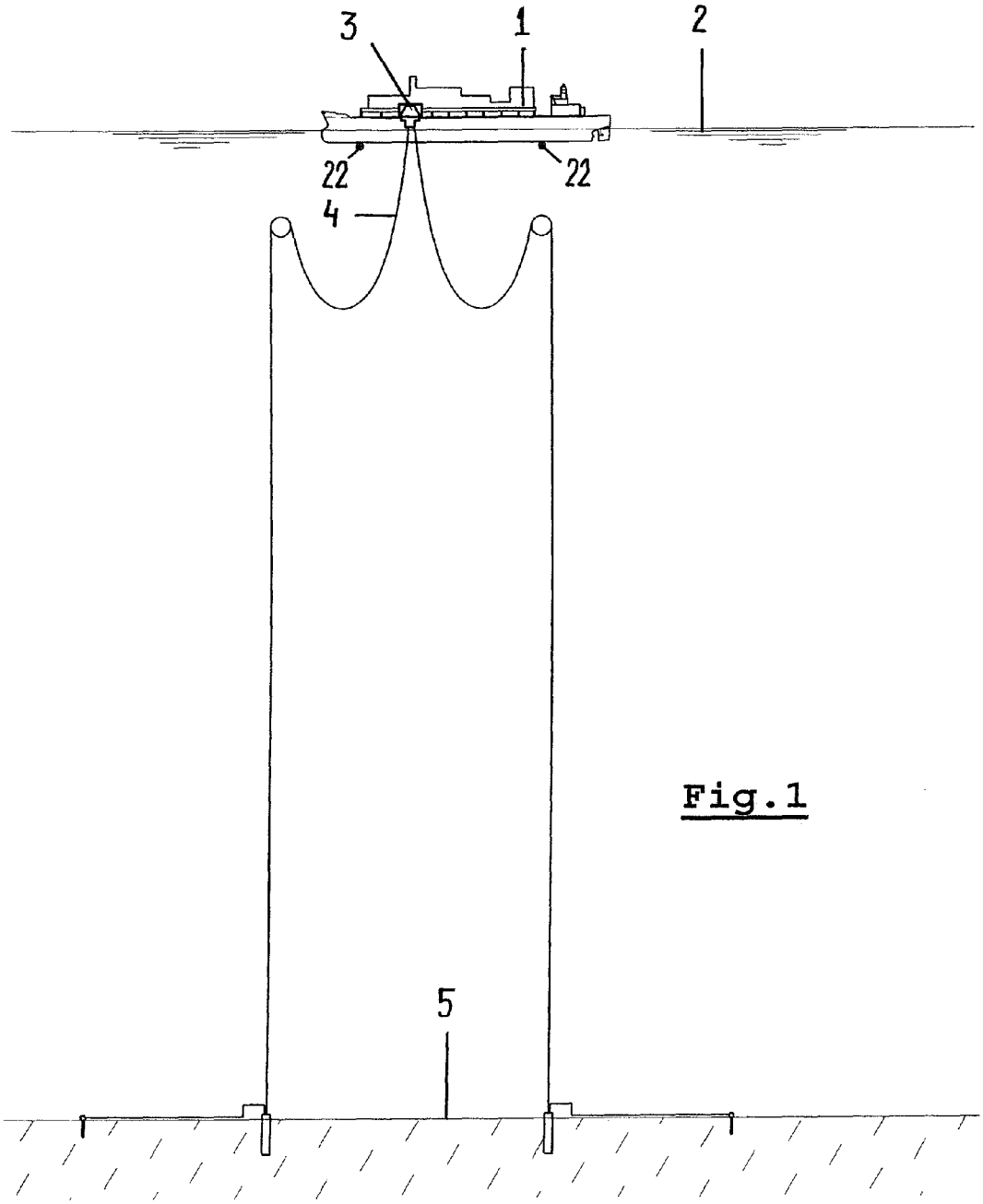
FIG. 1 shows, schematically, a combination of riser assembly and vessel.

FIG. 1 shows how a floating vessel 1 maintains its position on the sea 2 by, for example, propulsion device 22. Attached to this vessel is an outrigger 3, preferably above water, from which flexible risers 4 with a top end are supported. The other end of each of these risers is, in a way known per so, attached to the seafloor 5.

Figure 2:
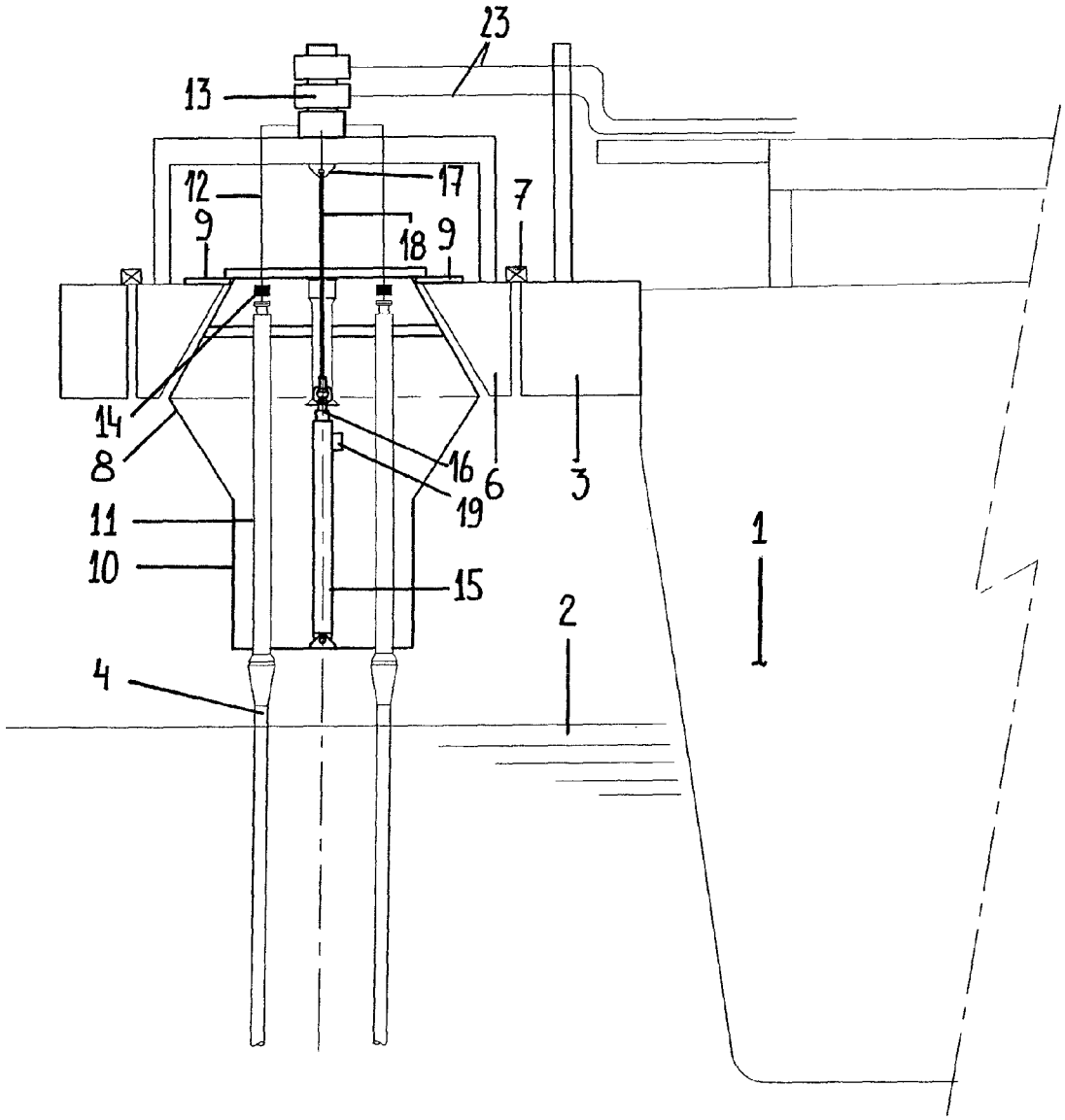
FIG. 2 shows, on an enlarged scale, a detailed cross sectional view of the combination of riser assembly and outrigger.

FIG. 2 provides more detail on a layout of the outrigger 3. Outrigger 3 is fitted with a turntable 6, which can rotate more than 360 degrees either way by means of a bearing arrangement 7.

A riser top body 8 is attached to the turntable 6 by quick acting latches 9. This riser top body consists primarily of a floating body 10. The risers 4 are attached at their upper terminations to piping 11 inside the floating body 10. This piping 11 in turn connects to piping 12 which connects again to a fluid swivel assembly 13. The fluid swivel assembly 13 is connected to the vessel deck piping 23. Between piping 11 and piping 12 a quick flow disconnect device 14 is provided.

A hydraulic cylinder-piston assembly 15 is fitted inside the floating body 10 of the riser top body 8. Its cylinder housing is permanently connected to the floating body 10.

When the riser top body 8 is hooked up to the turntable 6, by means of the latches 9, the piston 16 of the hydraulic cylinder-piston assembly 15 is connected to a strongpoint 17 on the turntable 6 by a steel wire 18. This steel wire 18 has strength sufficient to carry the full weight of the riser assembly including riser top body 8 and risers 4.

It is noted, that the connection of the piston 16 to a strongpoint 17 by means of a steel wire 18 only represents one possible manner of obtaining such a connection. It is also possible, for example, that the piston 16 is directly attached to a strongpoint 17 on the turntable 6.

When the quick flow disconnect devices 14 have been released and when the quick acting latches 9 are operated (i.e. moved to an inoperative position), the riser top body 8 will accelerate downward due to gravity, only to be slowed down by the wire 18 pulling on the piston 16 of the cylinder-piston assembly 15. The fluid content of the cylinder-piston assembly is an environmentally safe fluid, which can be for example inhibited water, rather than hydraulic fluid, which is then pressurised by the weight of the entire riser assembly. This fluid content is then released into the surrounding atmosphere through a port 19, located near the upper end of the cylinder housing. This port 19 has a pre-determined cross-sectional area and shape along the streamlines of the fluid pushed past it, such that the flow speed of the fluid through this port is limited to a certain value, this value being a direct function of the cross sectional area and shape of the port 19. This flow speed determines therefore directly the volume of fluid expelled from the cylinder in any time span and therefore determines the speed of axial extension of the piston 16. Hence, by selecting the appropriate port 19 characteristics the "free fall" speed of the riser assembly can be limited to any desired value.

Of course, when the braking device is realised in a different manner, for example by means of a braked winch member, other measures can be taken for obtaining the desired "free fall" speed of the riser assembly. At present, however, the embodiment in which the braking device comprises a cylinder-piston assembly, seems most promising.

The piston 16 has a stroke such that the riser top body 8 is lowered to a position whereby it starts to pick up some buoyancy from the surrounding sea 2 when the piston 16 is at its maximum extension. At that point the riser top body will be released from its suspension wire 18 by operating a latch 20. This latch opens automatically when piston 16 is near the end of its stroke as shown in FIG. 3.

Figure 3:
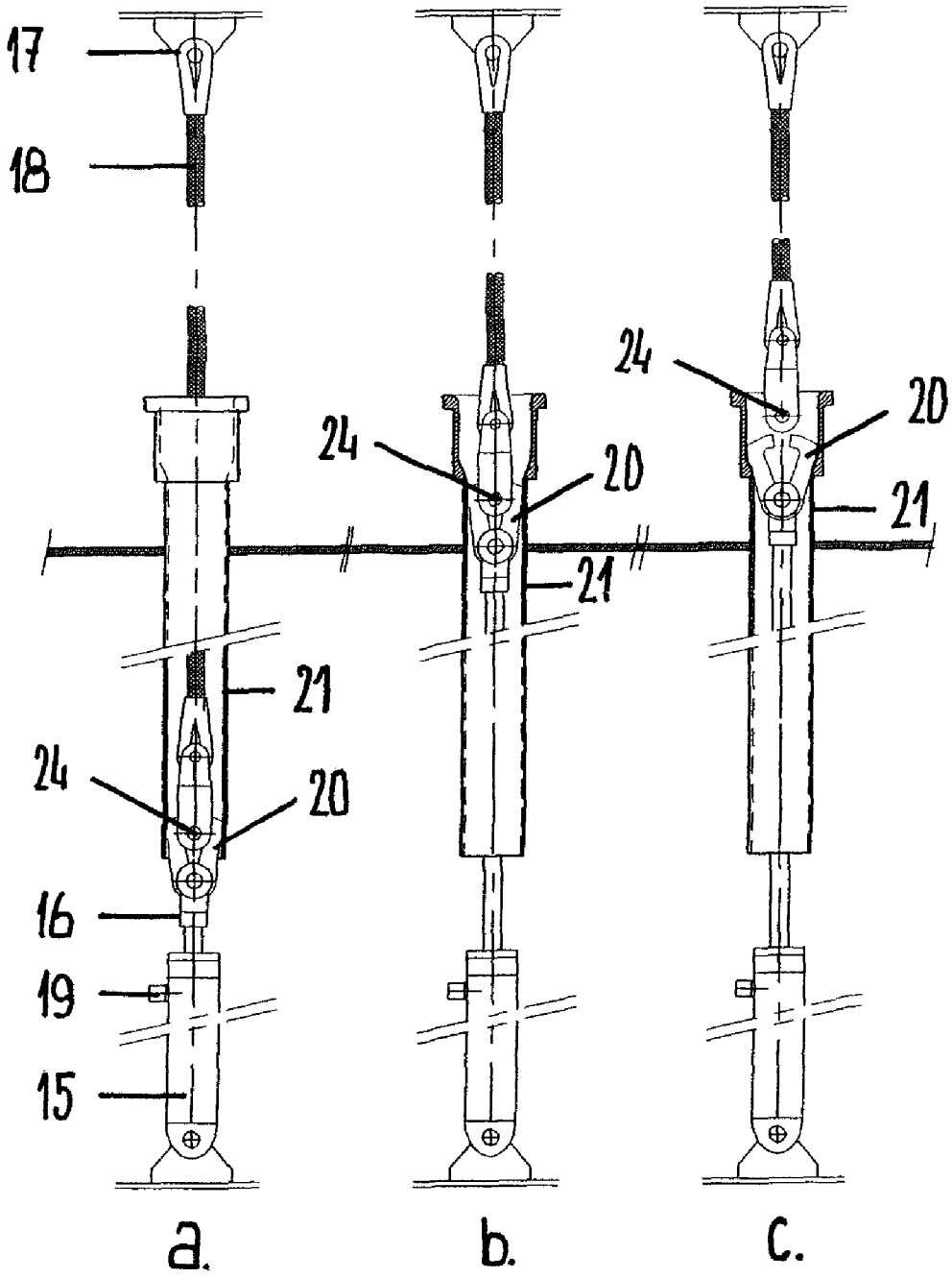
FIG. 3 shows an example of the unlocking operation of a braking device.

This latch 20 can be configured in many ways, only one such configuration being shown in FIG. 3, whereby the latch 20 comprises two pivotable jaws or arms constrained closed (see FIG. 3) around a counter part 24 (attached to wire 18) by a surrounding pipe 21 for most of its stroke. The pipe 21 is enlarged at its upper end, allowing the latch 20 to be pulled open (FIG. 3*c*) by the tension of the wire 18 and the loss of restraint from the pipe wall 21.

The above described arrangement with latch 20 basically defines a locking mechanism acting purely mechanically. It is noted, however, that such locking mechanism also could be unlocked using other means, such as for example electrical or electronical devices which could comprise sensors determining an appropiate position of the riser top body (for example by determining the position of the piston 16 within the cylinder housing).

The arrangement of the cylinder housing of the cylinder-piston assembly 15 is inside the riser top body 8, as this allows the easiest physical integration of all elements. It is clear however that this invention can also be applied with the cylinder housing being fitted on the turntable 6.

The invention can also be employed for disconnectable mooring systems where both anchor lines and flexible risers are connected to a disconnactable buoy.

Although, in the above, an embodiment has been described using a turntable 6, it is noted that aspects of the present invention also extend to disconnectable mooring systems, in which the outrigger is not provided with such a turntable, such that the riser top body is directly latched to the outrigger.

Further it should be noted that, although an outrigger has been illustrated which extends outwardly from the hull of the vessel, the present invention also is applicable to a situation, in which the vessel comprises an outrigger which extends above a so-called moon pool within the boundaries of the hull of the vessel.

The present invention is not limited to the embodiments described before, which may be varied widely within the scope of the invention as defined by the appending claims.

The invention claimed is:

1. A disconnectable mooring system, comprising a vessel with an outrigger supporting a riser assembly in a disconnectable manner, which riser assembly is provided with a riser top body which by means of disconnectable latch is attached to the outrigger, wherein the riser top body additionally is connected to the outrigger by a braking device arranged to temporarily control the downward speed of the riser top body after disconnecting the latch, which braking device comprises a cylinder-piston assembly wherein the cylinder is permanently connected to the top riser body and wherein the piston is releasably connected to the outrigger by a locking device which is unlocked when the piston has reached a predetermined extended position relative to the cylinder.

2. The disconnectable mooring system according to claim 1, wherein the locking device is unlocked purely mechanically.

3. The disconnectable mooring system according to claim 2, wherein the locking device comprise a latch with two pivotable latching arms.

4. The disconnectable mooring system according to claim 1, wherein the locking device is unlocked is operated based on an output of a sensor.

5. The disconnectable mooring system according to claim 1, wherein the piston of the cylinder-piston assembly displaces an environmentally safe fluid through a discharge opening towards the surrounding environment.

6. The disconnectable mooring system according to claim 1 and further comprising a turntable configured to connect the riser top body to the outrigger.

7. The disconnectable mooring system according to claim 1, wherein the outrigger extends outwardly from the hull of the vessel.

8. The disconnectable mooring system according to claim 1, wherein the outrigger extends above a moonpool within the boundaries of the hull of the vessel.

9. The disconnectable mooring system according to claim 1, wherein the locking device comprise a latch with two pivotable latching arms.

10. The disconnectable mooring system according to claim 9, wherein the pivotable latching arms are opened and closed as a function of contact of the latch with an inner surface of a pipe.

11. A riser assembly for releasably connecting to a vessel in a disconnectable mooring system, the riser assembly comprising:

a riser top body having a latch assembly arranged to releasably connect to a vessel; and a braking device carried by the riser top body, the braking device arranged to temporarily control the downward speed of the riser top body after disconnecting the latch assembly, wherein the braking device comprises a cylinder-piston assembly and a locking device, wherein the cylinder-piston assembly comprises a cylinder permanently connected to the top riser body and a piston movable relative to the cylinder, wherein the piston is releasably connected to the vessel by the locking device which is unlocked when the piston has reached a predetermined extended position relative to the cylinder.

12. The riser assembly of claim 11 wherein the locking device is operated due to contact with an element of the top riser body.

13. The riser assembly of claim 12 wherein the locking device comprises a pivotable latching arm.

14. The riser assembly of claim 13 wherein the element comprises a pipe, wherein the locking device moves axially within the pipe.

15. The riser assembly of claim 14 wherein one end of the pipe is enlarged such that the pivotable latching arm is allowed to pivot to an open position in order to release the locking device from the vessel.

16. The riser assembly of claim 11 wherein the piston of the cylinder-piston assembly displaces an environmentally safe fluid through a discharge opening towards the surrounding environment.

17. A disconnectable mooring system comprising:

a vessel; and a riser assembly for releasably connecting to the vessel, the riser assembly comprising:

a riser top body having a latch assembly arranged to releasably connect to a vessel; and a braking device carried by the riser top body, the braking device arranged to temporarily control the downward speed of the riser top body after disconnecting the latch assembly, wherein the braking device comprises a cylinder-piston assembly and a locking device, wherein the cylinder-piston assembly comprises a cylinder permanently connected to the top riser body and a piston movable relative to the cylinder, wherein the piston is releasably connected to the vessel by the locking device which is unlocked when the piston has reached a predetermined extended position relative to the cylinder.

18. The disconnectable mooring system of claim 17 wherein the locking device is operated due to contact with an element of the top riser body.

19. The disconnectable mooring system of claim 18 wherein the locking device comprises a pivotable latching arm.

20. The disconnectable mooring system of claim 19 wherein the element comprises a pipe, wherein the locking device moves axially within the pipe.

21. The disconnectable mooring system of claim 20 wherein one end of the pipe is enlarged such that the pivotable latching arm is allowed to pivot to an open position in order to release the locking device from the vessel.

22. The disconnectable mooring system of claim 17 wherein the piston of the cylinder-piston assembly displaces an environmentally safe fluid through a discharge opening towards the surrounding environment.

23. The disconnectable mooring system according to claim 17, wherein the vessel includes an outrigger, the riser assembly being releasably connected to the outrigger.

24. The disconnectable mooring system according to claim 23, wherein the outrigger includes a wire, the locking device being releasably connected to the wire.

25. The disconnectable mooring system according to claim 23, wherein the outrigger extends outwardly from a hull of the vessel.

26. The disconnectable mooring system according to claim 23, wherein the outrigger extends above a moonpool within the boundaries of a hull of the vessel.

* * * * *